US008578712B2

(12) United States Patent
Natali

(10) Patent No.: US 8,578,712 B2
(45) Date of Patent: Nov. 12, 2013

(54) METHOD FOR CALIBRATING PNEUMATIC ACTUATORS AND CALIBRATED ACTUATOR OBTAINABLE WITH THIS METHOD

(75) Inventor: Gianfranco Natali, Sorengo (CH)

(73) Assignee: Faist Ltd(Holdings), London (GB)

( * ) Notice: Subject to any disclaimer, the term of this patent is extended or adjusted under 35 U.S.C. 154(b) by 313 days.

(21) Appl. No.: 12/905,800

(22) Filed: Oct. 15, 2010

(65) Prior Publication Data

US 2011/0099999 A1 May 5, 2011

(30) Foreign Application Priority Data

Oct. 30, 2009 (IT) ..... VR2009A0183

(51) Int. Cl.
*F02D 23/00* (2006.01)

(52) U.S. Cl.
USPC ..... 60/602; 91/392; 123/90.14

(58) Field of Classification Search
USPC ..... 60/600, 602, 605.1, 620, 624; 123/90.14; 91/392
See application file for complete search history.

(56) References Cited

U.S. PATENT DOCUMENTS 4,102,712 A * 7/1978 Martin ..... 362/468
4,391,184 A 7/1983 Namane et al.
5,159,815 A 11/1992 Schlamadinger
6,658,846 B1 * 12/2003 McEwan ..... 60/602
6,895,947 B2 * 5/2005 Allmang et al. ..... 123/559.3

FOREIGN PATENT DOCUMENTS

DE 3037490 A1 4/1981
DE 4334831 A1 11/1994
DE 202008011150 U1 12/2008
FR 2833104 A1 6/2003
IT 1354723 2/2009
IT VR2009A1354000042 3/2009

* cited by examiner

*Primary Examiner* — Ching Chang
(74) *Attorney, Agent, or Firm* — Pearne & Gordon

(57) ABSTRACT

A method for calibrating pneumatic actuators comprising a containment structure (2) in which a diaphragm (4) is mounted which delimits a variable-volume chamber (5) whose internal pressure may be varied, and a rigid rod (8) able to slide through the containment structure (2) and connected to the diaphragm (4). At least one connecting head (11) can be mounted on an external second end (10) of the rigid rod (8) for connecting to an element to be controlled, such as a crank of a turbo-compressor. The method comprises the operating steps of varying the pressure in the variable-volume chamber (5) until a predetermined value is reached, thus bringing the rigid rod (8) to a corresponding operating position, positioning the connecting head (11) in a predetermined position relative to the containment structure (2) of the actuator and constraining the connecting head (11) to the rigid rod (8) in such a way that with the rigid rod (8) in the operating position the head (11) is in the predetermined position relative to the containment structure (2).

19 Claims, 5 Drawing Sheets

METHOD FOR CALIBRATING PNEUMATIC ACTUATORS AND CALIBRATED ACTUATOR OBTAINABLE WITH THIS METHOD

This invention relates to a method for calibrating pneumatic actuators and a calibrated actuator obtainable with this method. In particular, this invention relates to pneumatic actuators for vehicles with an internal combustion engine and more particularly to those actuators used for adjusting and controlling turbo-compressors.

Therefore, that range of actuators is referred to in this text, although this invention may in any case also apply to actuators intended for other uses, provided that they have similar calibration requirements.

In general, pneumatic actuators are devices which have a containment structure the inside of which forms a chamber divided into two further chambers by a gas-tight mounted flexible diaphragm. Attached to the diaphragm there is a first end of a straight actuating bar which extends through the containment structure and which has a second end that in practice is connected to the device to be controlled (such as the crank of a turbo-compressor), by means of a connecting head integral with it.

At least one of the two chambers formed by the diaphragm in the actuator, as well as being a chamber whose volume is variable depending on the shape adopted by the diaphragm, is made in such a way that it is fluid-tight and is connected with a duct through which it is possible to vary its internal pressure (by generating an overpressure or vacuum using an external source). Fixed to the diaphragm there is a coupling cup and interposed between the cup and the containment structure there is a spring designed to oppose the changes in the volume of the variable-volume chamber (in the most widespread solutions in which a vacuum is used, the spring tends to keep the chamber at its maximum volume).

The combined action of the pressure variation and the spring may therefore cause a controlled movement of both the diaphragm and, consequently, the end of the bar integral with it.

The connecting head fixed to the actuating bar may be screwed on the bar or welded onto it.

In the former case, the reciprocal position of the connecting head and the bar can be varied, whilst in the latter case obviously that it not possible.

To be able to control the position of the bar in practice, the actuators also comprise suitable detector means which may have different forms, depending on requirements. Examples of such detection means are described in Italian patent No. 1354723 and in Italian patent application No. VR2009A000042.

However, the prior art described above has several disadvantages, in particular relative to the behaviour of the actuators in practice and therefore the possibility of making standardised actuators with constant performance.

The operation of a typical actuator of the known type for turbo-compressors is represented for example by the continuous line in FIGS. 1 and 2 which on the x-axis show the movement of the actuating bar relative to the home condition (in which the variable-volume chamber is at atmospheric pressure) and on the y-axis show the pressure difference compared with atmospheric pressure (advantageously, a vacuum is used).

In practice, starting from a stationary condition (actuating bar stationary) and increasing the absolute value of the pressure difference, there is an initial step in which the bar remains stationary in any case, due to the frictions involved and the elasticity of the diaphragm. Then the further increase in the absolute value of the pressure difference causes a substantially linear movement of the actuating bar. Similar but inverted operation is obtained when, starting from a stationary situation, the pressure difference is reduced in the variable-volume chamber.

In other words, as shown in FIGS. 1 and 2, the behaviour of an actuator is always affected by a certain hysteresis which, the structure being the equal, is substantially the same for all actuators (from this viewpoint the differences in behaviour between individual actuators are minimal and may be ignored).

In contrast, there are significant differences between the various actuators regarding the correspondence between the absolute position of the actuating bar and pressure difference in the variable-volume chamber.

Two possible differences in behaviour are illustrated by the cycles shown with a long dash—short dash line in FIGS. 1 and 2. In particular, FIG. 1 highlights the case of an actuator which causes the same movement of the actuating bar represented by the continuous line, but with respect to a different range of variation of the pressure in the variable-volume chamber. In contrast, FIG. 2 illustrates the behaviour of the same actuator if the pressure is varied as for the actuator whose behaviour is shown with the continuous line. As can be seen, the movement obtained is significantly different in the two cases.

The arrow with two tips shown in FIGS. 1 and 2 indicates the difference in the behaviour of the two actuators (in both cases it is around 1 mm over a total stroke of 4 mm). In particular, the arrow indicates the difference in position, the pressure being equal.

In FIGS. 1 and 2 the dashed lines indicate the empirical range of possible variation of the behaviour of a family of commercial actuators which are all theoretically the same as each other.

In light of the variability of the behaviours of actuators, it appears evident how, during use, at the moment of installation on the vehicle it is necessary to empirically calibrate the pair consisting of the actuator—element to be controlled, in such a way as to obtain correct control of the turbo-compressor.

If the connecting head is screwed onto the rod, this can be achieved by adjusting the tightening of the head. In contrast, if the head is fixed to the rod in a non-adjustable fashion, calibration must involve the control unit relative to control of the pressure in the variable-volume chamber.

However, in both cases, once calibration has been done, correct operation is guaranteed by the means for detecting the position of the rod.

In this situation the technical purpose which forms the basis of this invention is to provide a method for calibrating pneumatic actuators and a calibrated actuator obtainable with this method, which overcome the above-mentioned disadvantages.

In particular, this invention has for a technical purpose to provide a method for calibrating pneumatic actuators which allows calibration in advance of all actuators before they are used and which therefore guarantees the same behaviour by all actuators of a predetermined type.

The technical purpose specified and the aims indicated are substantially achieved by a method for calibrating pneumatic actuators and by a calibrated actuator obtainable with this method as described in the appended claims.

Further features and the advantages of this invention are more apparent in the detailed description of a preferred, non-limiting embodiment of a method for calibrating pneumatic actuators and a calibrated actuator obtainable with this method illustrated in the accompanying drawings, in which.

With reference to the accompanying drawings the numeral 1 denotes as a whole a pneumatic actuator which can be calibrated in accordance with this invention.

Figure 3:
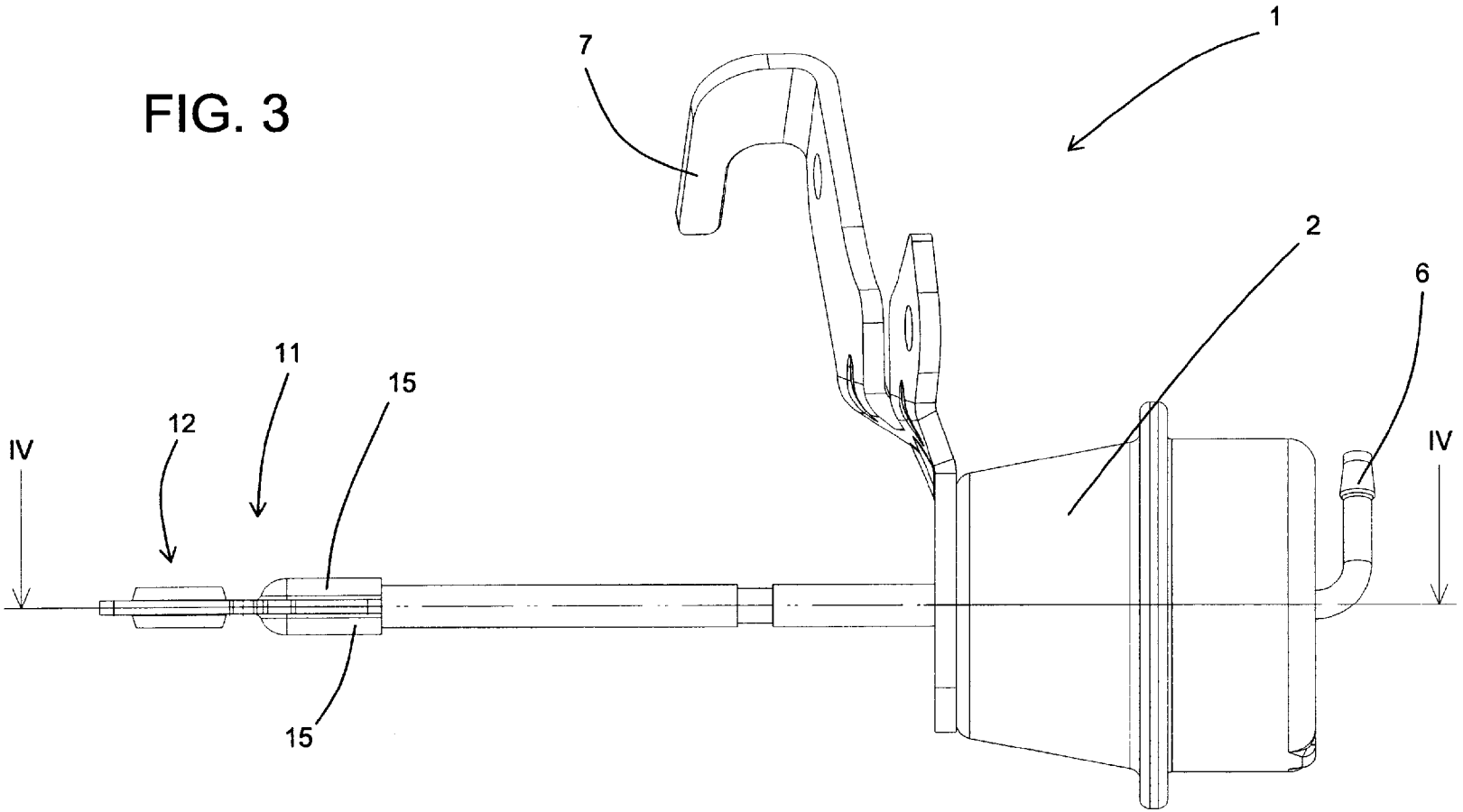
FIG. 3 is a side view of an actuator to be calibrated in accordance with this invention.

The pneumatic actuator 1 for which this invention may be applied in general comprises a containment structure 2 the inside of which forms an operating chamber 3 in which a flexible diaphragm 4 is mounted. Inside the containment structure 2 the diaphragm 4 delimits at least one fluid-tight variable-volume chamber 5, to which at least one duct 6 is connected, allowing its internal pressure to be varied (in practice, the duct 6 is connected to a device able to generate an overpressure or a vacuum). As shown in FIG. 3, fixed to the outside of the containment structure 2 there is a shaped flange 7 for mounting the actuator 1 (for example on the vehicle).

At least one rigid rod 8 is slidably mounted through the containment structure 2. The first end 9 of the rod is integral with the diaphragm 4 and the second end 10 of the rod is positioned outside the containment structure 2. This second end can be fitted with at least one connecting head 11 designed to allow the actuator 1 to be connected to an element to be controlled, such as a crank of a turbo-compressor.

As is explained in more detail below, the position of the connecting head 11 relative to the rigid rod 8 must be variable before the calibrating method is implemented, but must remain unchanged after the calibrating method has been implemented.

Moreover, preferably the connecting head 11 comprises a ball joint 12 for connecting to the element to be controlled, such as the crank of a turbo-compressor. In particular, the ball joint 12 is designed to compensate for any misalignment which may occur between the connecting head 11 and the element to be controlled.

Figure 7:
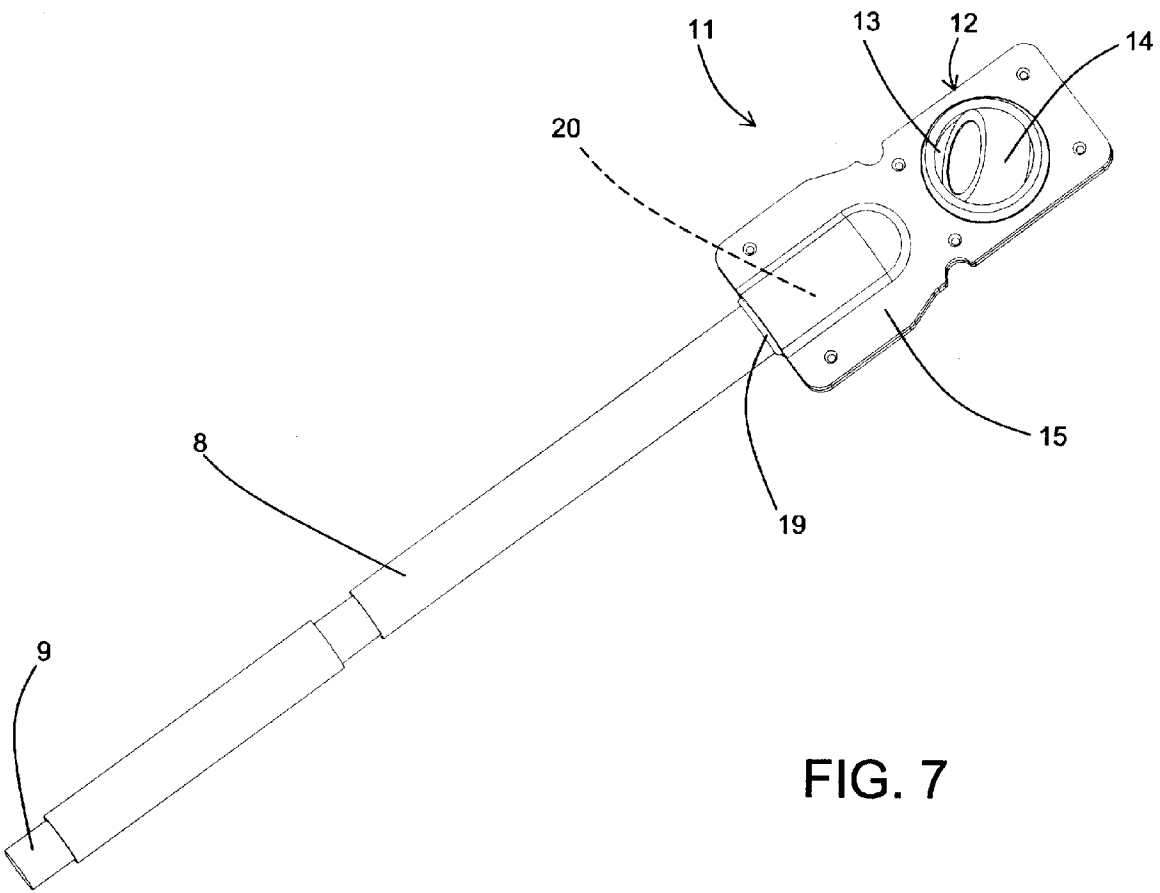
FIG. 7 is a second axonometric view of the detail of FIG. 5.
Figure 6:
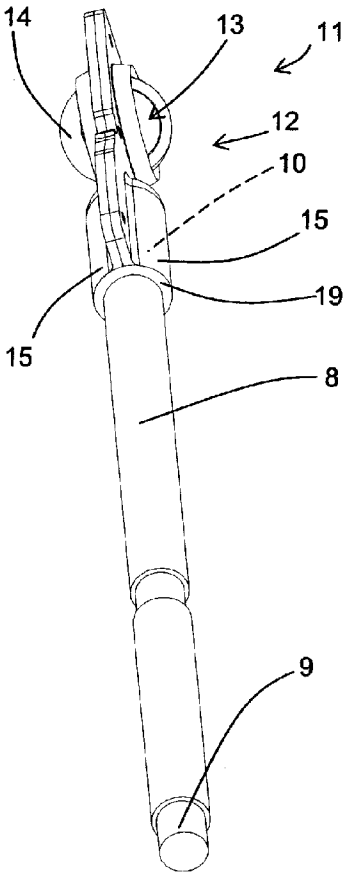
FIG. 6 is a first axonometric view of the detail of FIG. 5.

In the accompanying drawings the ball joint 12 comprises a seat 13 forming an inner surface which approximately has the shape of a spherical zone (advantageously with two specular bases), and a connecting bush 14 whose outside is shaped to match the seat 13 and rotatably inserted in it. In particular, the bush 14 forms the coupling element for connection to the element to be controlled (in FIGS. 6 and 7 the bush 14 is shown rotated relative to the seat 13 so as to highlight the hollow spherical zone shape). Moreover, in the case illustrated, in the home condition the ball joint 12 is symmetrical relative to the plane IV-IV illustrated in FIG. 3.

Figure 5:
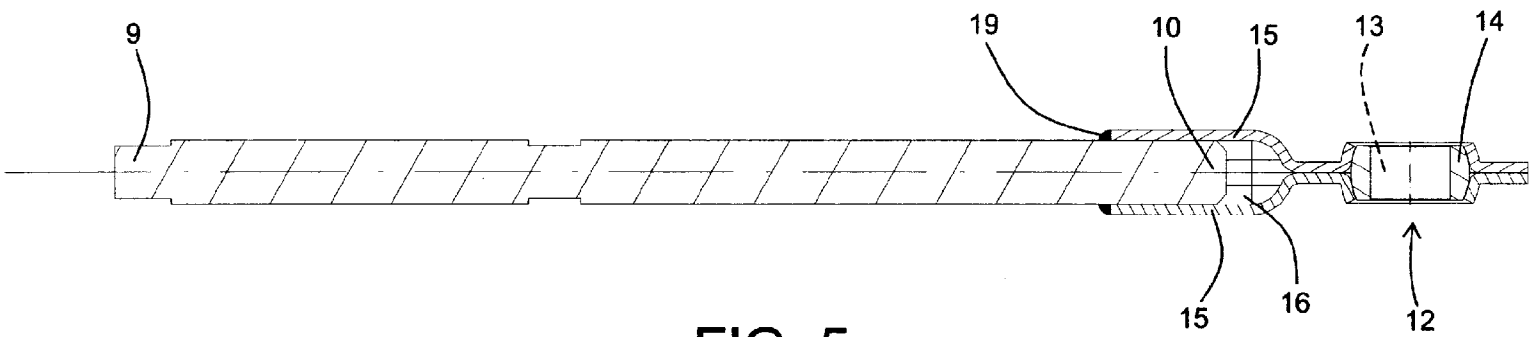
FIG. 5 is a detail of the actuator of FIG. 3, shown in cross-section according to a section plane perpendicular with that of FIG. 4, at the end of the calibration method in accordance with this invention.

Moreover, advantageously, the connecting head 11 illustrated in the accompanying drawings comprises two connected shells 15 which are positioned symmetrically relative to the plane IV-IV of FIG. 3 (FIG. 5). Each shell 15 therefore forms half of the seat 13 which has the shape of a spherical zone, and half of a housing 16 designed to allow connection of the connecting head 11 to the rigid rod 8, as explained in more detail below. Said housing 16 has a mainly cylindrical shape, shaped to match the rigid rod 8 and is open at a base of the cylinder centred on the main axis of extension of the rigid rod 8 (obviously once the head 11 is mounted on the rigid rod 8).

In the embodiment illustrated, inside the containment structure 2 the actuator 1 also comprises a rigid cup 17 integral with the diaphragm 4 and at the first end 9 of the rigid rod 8, and a spring 18 mounted between the rigid cup 17 and the containment structure 2. The rigid cup 17 is designed to act as an interface between the diaphragm 4 and the spring 18 (however, this is a prior art solution which is therefore not described in detail herein).

Figure 4:
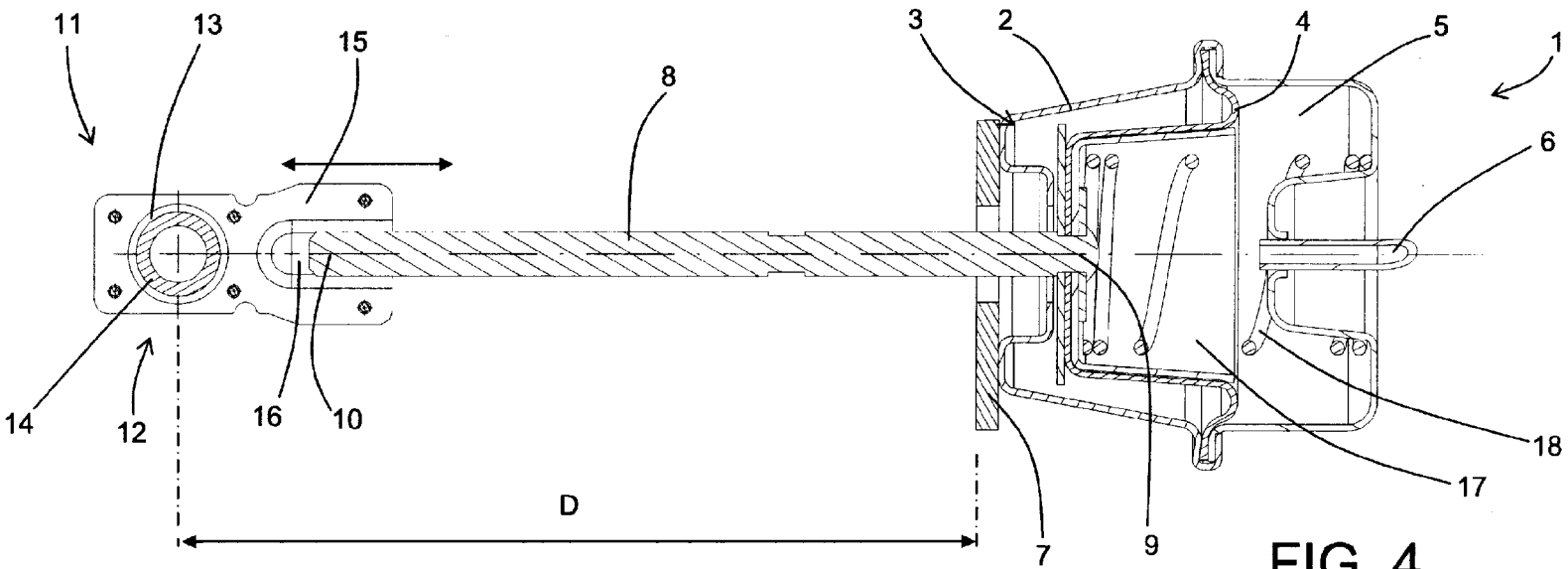
FIG. 4 is a cross-section of the actuator of FIG. 3 according to the line IV-IV.

In the extended condition the spring 18 pushes the rigid cup 17 and the diaphragm 4 towards the containment structure 2 in such a way that the rigid rod 8 projects by the maximum amount from the containment structure 2 (FIGS. 3 and 4). In this condition the variable-volume chamber 5 is also at its maximum volume.

Although not shown in the accompanying drawings, being of the known type, the actuator 1 may also comprise detection means which are operatively associated with the rigid rod 8 for identifying its position during operation (for example, its movement relative to the home condition illustrated in FIG. 4).

The calibrating method according to this invention comprises as the initial step that of taking an actuator 1 of the type described above with the connecting head 11 able to move relative to the second end 10 of the rigid rod 8.

Then, it comprises fixing the connecting head 11 to the rigid rod 8 in such a way that, with the rigid rod 8 in a predetermined operating position (determined by a predetermined pressure in the variable-volume chamber 5), the head 11 is in a predetermined position relative to the containment structure 2 (that is to say, at a predetermined distance from it).

To obtain that result, the calibrating method according to this invention comprises, before fixing the head 11 to the rigid rod 8, the implementation of two operating steps: a step of varying the pressure in the variable-volume chamber 5 until it reaches a predetermined value, thus bringing the rigid rod 8 into a corresponding operating position, and a step of positioning the connecting head 11 in a predetermined position relative to the containment structure 2. Depending on requirements, these two steps may be carried out in any order.

The pressure in the variable-volume chamber 5 may be varied both by creating an overpressure and by creating a vacuum, depending on the actuator 1 operating methods (that is to say, depending on the position of the variable-volume chamber 5 relative to the diaphragm 4). The aim of varying the pressure is to cause a movement of the rod similar to those which will occur during use. For example, in the embodiment illustrated in the accompanying drawings, a vacuum is created. In this way, the spring 18 is crushed, the volume of the variable-volume chamber 5 is reduced and the rigid rod 8 partly returns inside the containment structure 2. However, in general the pressure in the variable-volume chamber 5 is brought to the predetermined value from the atmospheric pressure by increasing or reducing the pressure by a predetermined value.

The step of positioning the connecting head 11 in the predetermined position relative to the rigid rod 8, may, as already indicated, be carried out either before or after varying the pressure in the variable-volume chamber 5. Moreover, advantageously, the predetermined position is established in advance in combination with the predetermined internal pressure value applied to the variable-volume chamber 5 based on the design decision according to which a predetermined variation in the pressure in the variable-volume chamber 5 must correspond to a predetermined position of the connecting head 11 and therefore of the element to be controlled.

In the most simple embodiment, as shown in the accompanying drawings, the position in space of the actuator 1 is fixed (for example using the fixing flange 7) and the connecting head 11 is positioned at a predetermined distance from a reference point of the actuator 1 (distance measured parallel with the direction of extension of the rigid rod 8). In the accompanying drawings, said distance D is for example identified as the distance measured parallel with the direction of extension of the rigid rod 8, between the actuator 1 fixing flange 7 and the centre of the ball joint 12 (of the bush 14) which is part of the connecting head 11.

In the embodiment illustrated in the accompanying drawings, if the positioning step is carried out first, the connecting head 11 is placed in the predetermined position with its housing 16 axially aligned with the rigid rod 8. The subsequent step of varying the pressure causes the rigid rod 8 to slide in the housing 16. If, in contrast, the first step carried out is the pressure variation, then the step of positioning the connecting head 11 may be carried out by simply fitting the housing 16 on the second end 10 of the rigid rod 8 until it reaches the predetermined position. In the embodiment illustrated, in both cases the step of positioning the connecting head 11 on the rigid rod 8 is carried out by sliding the head 11 on the rigid rod 8 parallel with the direction of extension of the rigid rod 8.

In other embodiments in which the various parts have different shapes or sizes, the steps just described may in any case be carried out using other methods.

Once the connecting head 11 is in the predetermined position and the pressure in the variable-volume chamber 5 is at the predetermined value, the method according to this invention comprises an operating step of constraining the connecting head 11 to the rigid rod 8. Advantageously, the step of constraining the connecting head 11 to the rigid rod 8 is carried out in such a way as to create a non-detachable constraint, for example by welding the connecting head 11 to the rigid rod 8 (the weld bead 19 is visible in FIGS. 5 to 7 which show the actuator 1 at the end of the calibrating step).

In this way, it is possible to obtain a calibrated pneumatic actuator 1 in which the connecting head 11 is fixed in a non-detachable fashion to the rigid rod 8 in such a way that it is in a predetermined position relative to the containment structure 2 when the pressure in the variable-volume chamber 5 is equal to a corresponding predetermined pressure.

Figure 1:
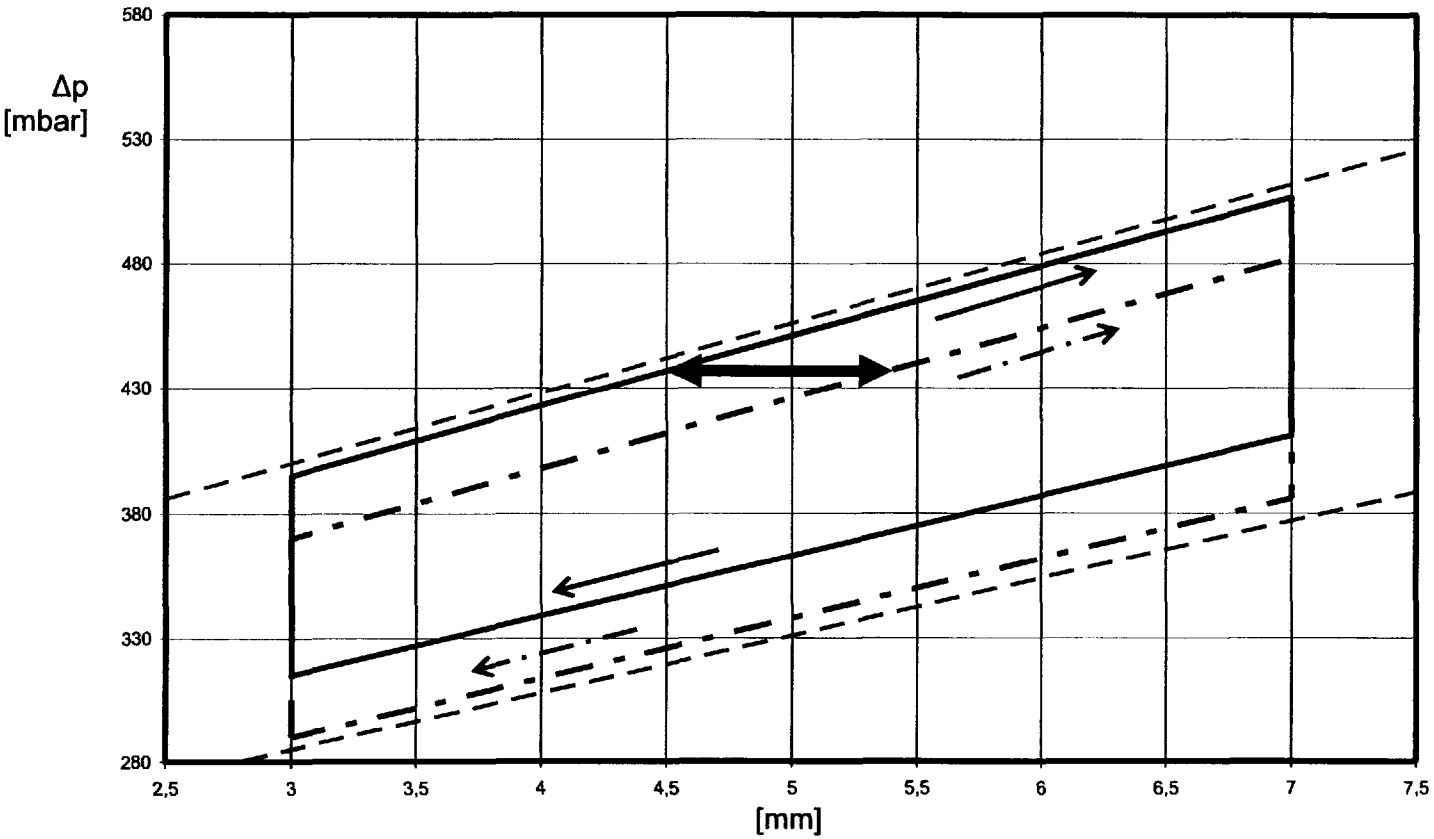
FIG. 1 shows a first possible behaviour of prior art actuators.
Figure 2:
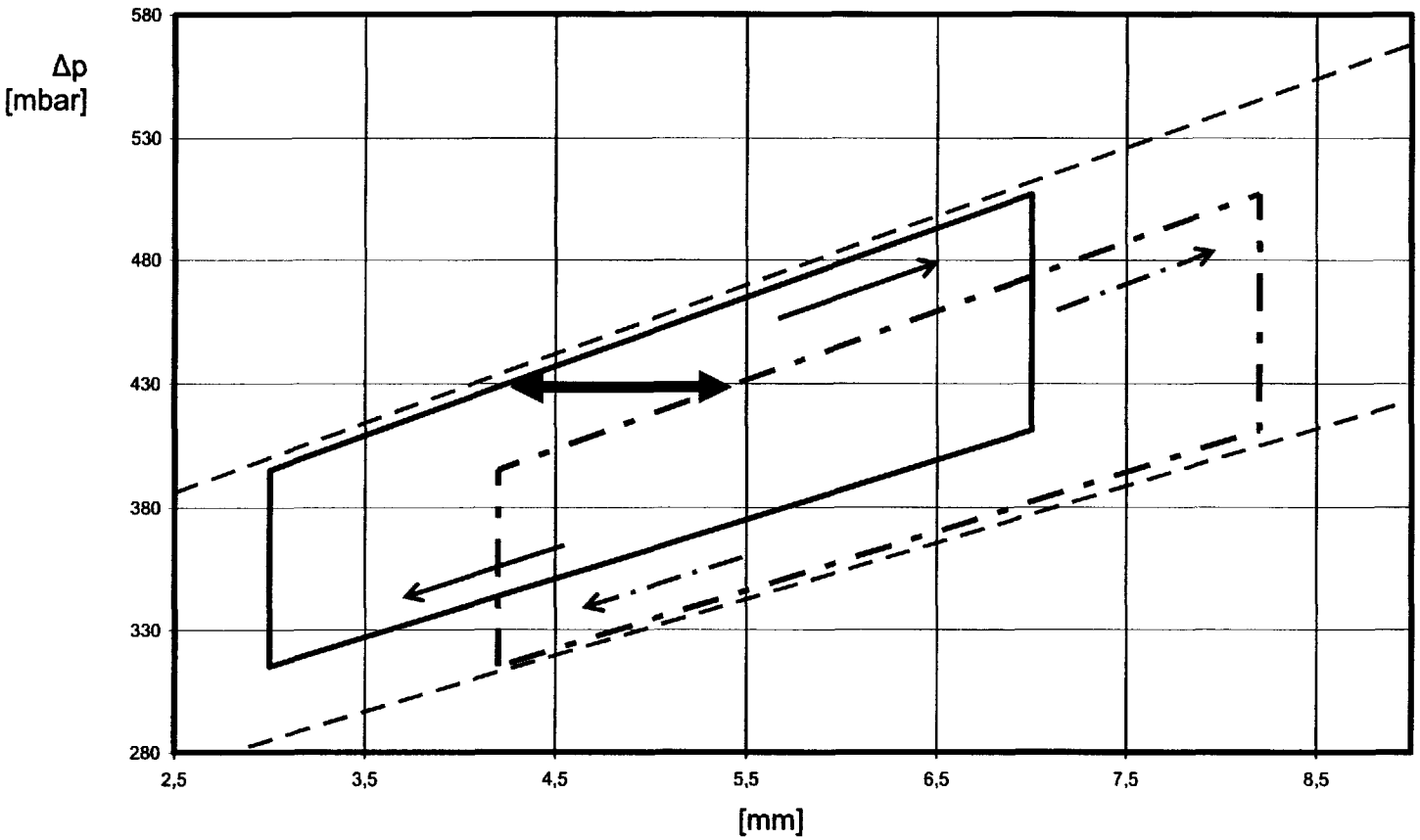
FIG. 2 shows a second possible behaviour of prior art actuators.

With reference to FIGS. 1 and 2 this means, for example, guaranteeing that for a pressure variation of 315 mbar compared with atmospheric pressure in the variable-volume chamber 5 the connecting head 11 is moved 3 mm relative to the home condition.

In this way, the behaviour of the actuator 1 substantially corresponds to that indicated by the continuous line in FIGS. 1 and 2, irrespective of its features which differentiate it from the other actuators which are theoretically identical to it.

This invention brings important advantages.

Thanks to the method according to this invention, once all of the actuators which have the same structure have been calibrated, they behave substantially in the same way (that is to say, they describe the same hysteresis cycle).

It should also be noticed that this invention is easy to produce and that even the cost linked to implementing the invention is not very high.

The invention described above may be modified and adapted in several ways without thereby departing from the scope of the inventive concept.

Moreover, all details of the invention may be substituted with other technically equivalent elements and in practice all of the materials used, as well as the shapes and dimensions of the various components, may vary according to requirements.

The invention claimed is:

1. A method for calibrating a pneumatic actuator for a vehicle with an internal combustion engine, the pneumatic actuator (1) comprising:

a containment structure (2) the inside of which forms an operating chamber (3);

a diaphragm (4) mounted in the operating chamber (3) for delimiting inside the chamber at least one variable-volume chamber (5);

at least one duct (6) connected to the variable-volume chamber (5), allowing its internal pressure to be varied;

at least one rigid rod (8) slidably inserted through the containment structure (2) and having a first end (9) fixed to the diaphragm (4) and a second end (10) which is outside the containment structure (2); and at least one connecting head (11) which can be mounted on the second end (10) of the rigid rod (8) for connecting to an element to be controlled;

the method being characterised in that it comprises the following operating steps:

taking the pneumatic actuator (1) with the connecting head (11) able to move relative to the second end (10) of the rigid rod (8);

varying the pressure in the variable-volume chamber (5) until it reaches a predetermined value, thus bringing the rigid rod (8) into a corresponding operating position;

positioning the connecting head (11) in a predetermined position relative to the containment structure (2), the predetermined position being established in advance together with the predetermined value of the pressure in the variable-volume chamber (5); and constraining the connecting head (11) to the rigid rod (8) in such a way that (a) with the rigid rod (8) in said corresponding operating position, the connecting head (11) is in the predetermined position relative to the containment structure (2), and (b) the connecting head (11) is solidly and rigidly fixed to the rigid rod (8) so that they cannot move relative to each other.

2. The method according to claim 1, characterised in that the step of constraining the connecting head (11) to the rigid rod (8) is carried out in such a way as to create a non-detachable constraint.

3. The method according to claim 2, characterised in that the pressure in the variable volume chamber (5) is brought to the predetermined value from the atmospheric pressure by increasing or reducing the pressure by a predetermined value.

4. The method according to claim 2, characterised in that the constraining step is carried out by welding the connecting head (11) onto the rigid rod (8).

5. The method according to claim 2, characterised in that the step of positioning the connecting head (11) is carried out by sliding the connecting head (11) on the rigid rod (8) parallel with the direction of extension of the rigid rod (8).

6. The method according to claim 2, characterised in that the step of positioning the connecting head (11) is carried out before varying the pressure in the variable-volume chamber (5) until the predetermined value is reached, the latter step causing the rigid rod (8) to slide relative to the connecting head (11).

7. The method according to claim 2, characterised in that the step of positioning the connecting head (11) is carried out by sliding the rigid rod in a housing (16) made in the connecting head (11).

8. The method according to claim 4, characterised in that the step of positioning the connecting head (11) is carried out by sliding the connecting head (11) on the rigid rod (8) parallel with the direction of extension of the rigid rod (8).

9. The method according to claim 4, characterised in that the step of positioning the connecting head (11) is carried out before varying the pressure in the variable-volume chamber (5) until the predetermined value is reached, the latter step causing the rigid rod (8) to slide relative to the connecting head (11).

10. The method according to claim 4, characterised in that the step of positioning the connecting head (11) is carried out by sliding the rigid rod in a housing (16) made in the connecting head (11).

11. The method according to claim 4, characterised in that the pressure in the variable volume chamber (5) is brought to the predetermined value from the atmospheric pressure by increasing or reducing the pressure by a predetermined value.

12. The method according to claim 1, characterised in that the step of positioning the connecting head (11) is carried out by sliding the connecting head (11) on the rigid rod (8) parallel with the direction of extension of the rigid rod (8).

13. The method according to claim 1, characterised in that the step of positioning the connecting head (11) is carried out before varying the pressure in the variable-volume chamber (5) until the predetermined value is reached, the latter step causing the rigid rod (8) to slide relative to the connecting head (11).

14. The method according to claim 1, characterised in that the step of positioning the connecting head (11) is carried out by sliding the rigid rod in a housing (16) made in the connecting head (11).

15. The method according to claim 12, characterised in that the pressure in the variable volume chamber (5) is brought to the predetermined value from the atmospheric pressure by increasing or reducing the pressure by a predetermined value.

16. The method according to claim 1, characterised in that the pressure in the variable-volume chamber (5) is brought to the predetermined value from the atmospheric pressure by increasing or reducing the pressure by a predetermined value.

17. A calibrated pneumatic actuator for a vehicle with an internal combustion engine, which can be calibrated using the method according to claim 1, characterised in that the connecting head (11) is fastened in a non-detachable fashion to the rigid rod (8) so that it is in a predetermined position relative to the containment structure (2) when the pressure in the variable-volume chamber (5) is equal to a corresponding predetermined pressure.

18. The actuator according to claim 17, characterised in that the connecting head (11) comprises a ball joint (12) for connecting to the element to be controlled.

19. The actuator according to claim 18, characterised in that the ball joint (12) comprises a seat (13) forming an inner surface with a spherical zone shape, and a connecting bush (14) whose outside is shaped to match the seat (13) and inserted in it, the bush (14) forming a coupling element for the connection to the element to be controlled.

* * * * *